US008496840B1

(12) United States Patent
Dunn et al.

(10) Patent No.: US 8,496,840 B1
(45) **Date of Patent: *Jul. 30, 2013**

(54) GREASE CONTAINMENT SYSTEMS AND METHODS

(75) Inventors: Joseph R. Dunn, Raleigh, NC (US); Darren Scott Jameson, Mansfield, TX (US)

(73) Assignee: DunnWell, LLC, Durham, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/567,006

(22) Filed: Aug. 3, 2012

Related U.S. Application Data

(63) Continuation of application No. 12/772,092, filed on Apr. 30, 2010.

(51) Int. Cl.
*F24C 15/20* (2006.01)
*B01D 35/02* (2006.01)

(52) U.S. Cl.
USPC ..... 210/800; 210/532.1; 55/DIG. 36

(58) Field of Classification Search
USPC ..... 210/671, 680, 690–693, 800–804, 210/248, 513, 532.1, 533, 536; 55/DIG. 36; 126/299 R–299 D; 405/36
See application file for complete search history.

(56) References Cited

U.S. PATENT DOCUMENTS 4,113,617 A 9/1978 Bereskin et al.
4,635,617 A 1/1987 Simonsen
4,869,236 A 9/1989 Blough
4,887,588 A 12/1989 Rial
4,987,882 A 1/1991 Kaufman
5,196,040 A 3/1993 Malloy et al.
5,318,607 A 6/1994 Malloy et al.
5,512,073 A 4/1996 Mirza et al.
5,540,744 A 7/1996 Renna
5,567,216 A 10/1996 Mirza et al.
5,814,115 A 9/1998 Allen et al.
6,010,558 A 1/2000 Ackland
6,143,047 A 11/2000 Jodoin et al.
6,391,074 B1 5/2002 McCrary (Continued)

OTHER PUBLICATIONS

Co-pending U.S. Appl. No. 12/772,092, filed Apr. 30, 2010.

(Continued)

*Primary Examiner* — Frank Lawrence, Jr.
(74) *Attorney, Agent, or Firm* — Vincent K. Gustafson; Jenkins, Wilson, Taylor & Hunt, P.A.

(57) ABSTRACT

A grease containment apparatus arranged to receive grease discharged by a fan-type rooftop grease exhauster includes multiple sumps and at least one trough disposed between the sumps. An apparatus may be disposed along two, three, or four sides of a rooftop grease exhauster, including corner sumps assemblies and/or end sump assemblies, preferably including associated rain shields, and optionally including one or more end caps. Components may be fabricated of UV-resistant polymeric materials such as ABS. Use of grease absorbent media may be avoided. A drain conduit may receive water from a sump, with at least a portion of the drain conduit being disposed at a level above a bottom edge of the sump.

13 Claims, 8 Drawing Sheets

U.S. PATENT DOCUMENTS

| | | | |
|---|---|---|---|
| 6,468,323 | B1 | 10/2002 | Chwala |
| 6,648,937 | B1 | 11/2003 | Nguyen et al. |
| 6,676,723 | B2 | 1/2004 | Chwala |
| 6,716,099 | B2 | 4/2004 | Pfleiderer et al. |
| 6,814,769 | B1 | 11/2004 | Stefanucci |
| 7,037,359 | B1 | 5/2006 | McCauley |
| 7,244,283 | B2 | 7/2007 | Mirza |
| 7,332,004 | B2 | 2/2008 | Jackson |
| 7,395,633 | B2 | 7/2008 | Baeta |
| 2004/0040219 | A1 | 3/2004 | Bacik et al. |
| 2009/0114094 | A1 | 5/2009 | Clap et al. |
| 2010/0199618 | A1 | 8/2010 | Tomkiewicz |

OTHER PUBLICATIONS

Facilitec Corporation, "Rooftop Grease Containment Products—Installation and Maintenance" website webpage, accessible at http://www.facilitec-east.com/rooftop/installation-and-maintenance.aspx, accessed on Mar. 18, 2011.

Facilitec Corporation; "Rooftop Grease Containment Products" website webpage, accessible at http://www.facilitec-se.com/rooftop/how-it-works.aspx, accessed on Jun. 2, 2009.

Unknown, Photograph and description of grease containment system with single sump (pictured at lower center) attached to base of rooftop grease exhauster fan, Nov. 2008, p. 1.

GREASE CONTAINMENT SYSTEMS AND METHODS

CROSS-REFERENCE TO RELATED APPLICATION

This application is a continuation of U.S. patent application Ser. No. 12/772,092 filed on Apr. 30, 2010. The disclosure of such U.S. patent application is hereby incorporated by reference herein in its entirety.

FIELD OF THE INVENTION

The present invention relates generally to grease containment systems for containing grease discharged by fan-type rooftop grease exhausters.

DESCRIPTION OF THE RELATED ART

Restaurants generate high volumes of grease that are discharged via roof mounted exhaust systems. Discharged grease may accumulate on a rooftop and lead to deterioration, as well as pose an extreme fire hazard.

Various systems have been developed to contain grease discharged via roof mounted exhaust systems; however, such systems suffer from limitations that restrict their utility.

Many conventional grease containment assemblies use filters, absorbents, and/or grease separating media disposed within a receptacle such as a duct or basin arrange to receive grease discharged (e.g., via a pipe or spout) from a roof-mounted grease exhauster. In systems utilizing grease separating and/or absorbent media, such media must be periodically changed to avoid release of grease onto a rooftop. Rooftop environments are subject to unpredictable amounts of rainfall, and incident rain may contact grease discharged by a rooftop grease exhauster. When rooftop environments are exposed to significant rainfall, a duct or basin containing grease separating media may overflow, causing grease to saturate the rooftop and pose a fire hazard. It would be desirable to minimize possibility of uncontrolled discharge of grease (e.g., overflow) from a grease containment system.

It can be burdensome for personnel to frequently access restaurant rooftops to check saturation status of grease separating and/or absorbent media, and such media can be expensive to change. It would be desirable to reduce the frequency with which grease containment assemblies must be accessed. It would also be desirable to minimize or eliminate the need for grease separating and/or absorbent media.

Rooftop grease exhausters are provided in numerous configurations and are installed in highly variable conditions, such as in relation to roof pitch, and in proximity to building structural elements and other rooftop-mounted mechanical equipment. It would be desirable to provide grease containment assemblies capable of accommodating highly variable rooftop grease exhauster installation conditions, without requiring shop fabrication of custom pieces (e.g., via sheet metal), and without requiring highly skilled labor to install grease containment assemblies.

A need therefore exist for improved grease containment systems and methods for use with rooftop mounted grease exhausters.

SUMMARY OF THE INVENTION

The present invention relates to grease containment systems and methods adapted to receive grease from (e.g., fan-type) rooftop grease exhausters, and to gravimetrically separate grease and water to permit water removal by evaporation and/or draining, preferably without requiring use of grease absorbent material.

In one aspect, the invention relates to a grease containment apparatus adapted to receive grease from a rooftop grease exhauster, the grease containment apparatus comprising: a plurality of sumps; and at least one trough operatively arranged between the plurality of sumps to conduct liquid to at least one sump of the plurality of sumps; wherein a portion of each sump of the plurality of sumps is arranged at a level below a lower edge of the at least one trough.

In another aspect, the invention relates to a grease containment apparatus adapted to receive grease from a rooftop grease exhauster, the grease containment apparatus comprising: at least one trough; and at least one sump operatively arranged to receive grease from the at least one trough, wherein the at least one sump comprises a side-mounted drain arranged to receive a drain plug, and wherein at least a portion of the at least one sump is arranged at a level below a lower edge of the at least one trough.

In a further aspect, the invention relates to a grease containment apparatus adapted to receive grease from a rooftop grease exhauster, the grease containment apparatus comprising: at least one trough; at least one sump operatively arranged to receive grease from the at least one trough, wherein at least a portion of the at least one sump is arranged at a level below a lower edge of the at least one trough; and at least one end cap coupled to any of (a) the at least one trough and (b) the at least one sump.

A further aspect of the invention relates to a grease containment apparatus adapted to receive grease from a rooftop grease exhauster, the grease containment apparatus comprising: at least one trough; at least one sump operatively arranged to receive grease from the at least one trough, wherein at least a portion of the at least one sump is arranged at a level below a lower edge of the at least one trough; and at least one drain conduit operatively coupled to the at least one sump, wherein a portion of the at least one drain conduit is disposed at a level above a bottom edge of the at least one sump.

Yet another aspect of the invention relates to a method comprising: draining grease from a rooftop grease exhauster into a grease containment apparatus comprising at least one trough and at least one sump operatively arranged to receive grease from the at least one trough, wherein at least a portion of the at least one sump is arranged at a level below a lower edge of the at least one trough; and draining water from the at least one sump through a flow path defined by a drain conduit coupled to the at least one sump, wherein at least a portion of the flow path is elevated above a bottom wall of the at least one sump.

In another separate aspect, any of the foregoing aspects or other features described herein may be combined for additional advantage.

Other aspects, features and embodiments of the invention will be more fully apparent from the ensuing disclosure and appended claims.

DETAILED DESCRIPTION OF THE INVENTION, AND PREFERRED EMBODIMENTS THEREOF

Figure 1B:
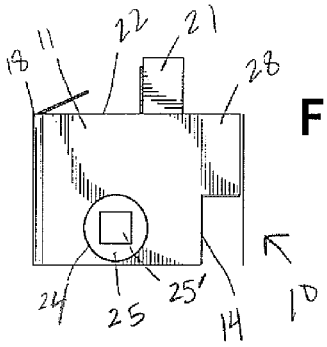
FIG. 1B is a front elevation view of the corner sump assembly of FIG. 1A.
Figure 2A:
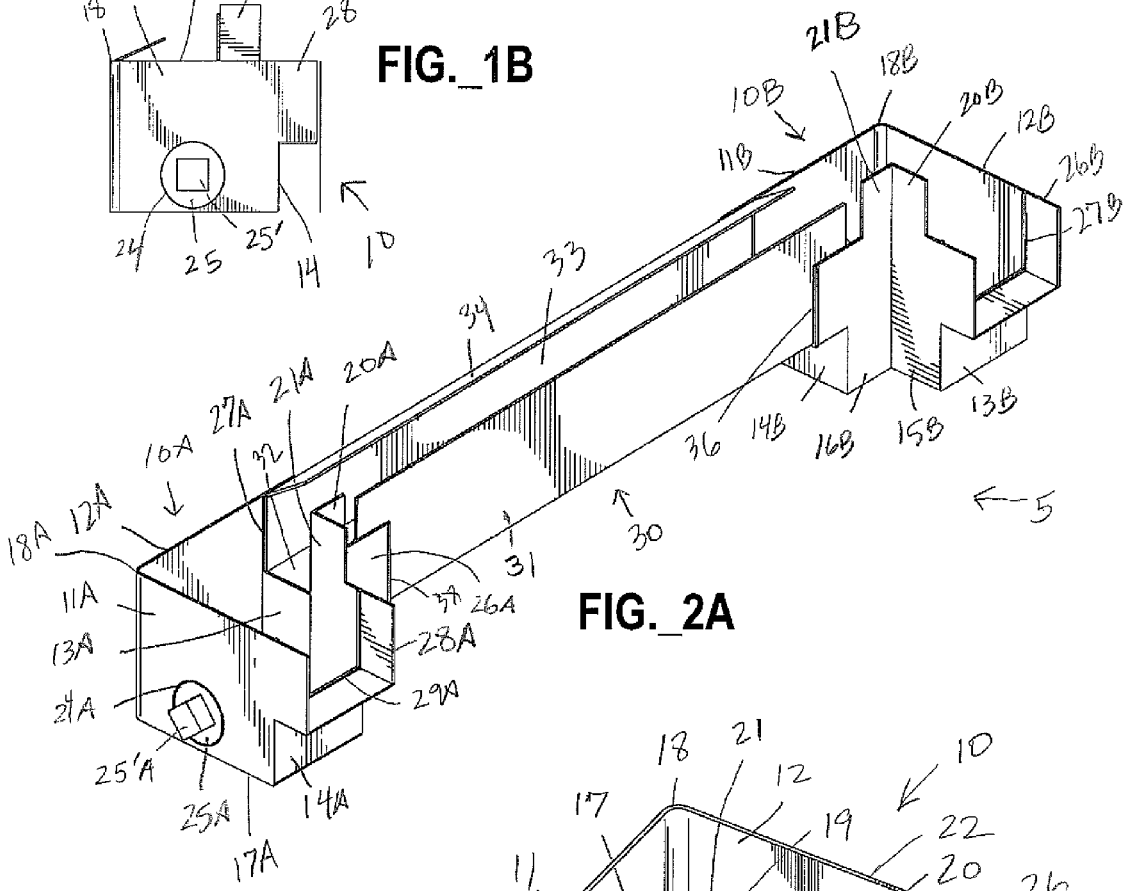
FIG. 2A is a perspective view of at least a portion of a grease containment apparatus including one trough connected to two corner sump assemblies according to another embodiment of the present invention.

Various aspects of the present invention relate to grease containment systems and methods adapted to receive grease from rooftop grease exhausters, and to gravimetrically separate grease and water to permit water removal by evaporation and/or draining, preferably without requiring use of grease absorbent material.

In one embodiment, a grease containment system is modular in character, and comprises multiple standardized pieces that may be readily assembled in the field without requiring custom shop fabrication. Such a grease containment system may include standardized pieces such as: at least one trough; at least one sump (preferably multiple sumps) such as may be embodied in a corner sump assembly or an end sump assembly having at least one sleeve portion arranged to receive therein an end of a trough; at least one non-sump corner portion (preferably having at least one sleeve portion), one or more end caps arranged for fitment to an end of a trough or a sleeve portion of a corner sump assembly, an end sump assembly, or a non-sump corner portion; trough connectors; and rain shields (such as may be arranged for fitment to one or more of the foregoing components).

The above-described components (e.g., trough(s), sump(s) as may be embodied in one or more corner sump assemblies and/or end sump assemblies, corner portions, end caps, and rain shields) are preferably fabricated of polymeric materials, by any suitable processes such as molding (including but not limited to injection molding). In one embodiment, average wall thicknesses are in a range of from 0.125 inch to about 0.250 inch (about 3.2 mm to about 6.4 mm). Desirable polymeric materials include materials resistant to modification or degradation in exposure to ultraviolet radiation. Preferred polymeric materials include acrylonitrile-butadiene-styrene (ABS) copolymer, and Acrylonitrile Butadiene Styrene/Polycarbonate (ABS/PC) copolymer or alloy. ABS/PC exhibits high flow, toughness, and heat resistance, as well as improved stiffness over conventional high impact ABS. Such material is desirably dark in color to promote absorption of heat (e.g., from sunlight) to accelerate evaporation of water within the grease containment apparatus. Various conventional additives such as UV stabilizers and flame retardants may optionally be added to the polymeric material, and reprocessed polymeric materials, rather than virgin materials, may be used. Following molding thereof, exterior surfaces may be textured by sandblasting, thermal imprinting, scoring, or other conventional means to provide increased surface area for heat transfer as well as improved aesthetics. The above-described pieces (e.g., troughs, sumps, corner portions, end caps, rain shields) may be easily cut in the field using a manually operated hacksaw or cordless circular saw. The foregoing pieces may be sealed to one another via any desirable means, with solvent welding or adhesive bonding being particularly preferred.

In certain embodiments, any one or more of components such as troughs, corner sumps, end sumps, non-sump corner portions, and trough connectors may include at least one hanger tab integrally formed with such component(s), and arranged to support the grease containment apparatus to receive grease from the rooftop grease exhauster. Such hanger tabs may be integrally molded with the foregoing components. In one embodiment, troughs are devoid of hanger tabs. In one embodiment, hanger tabs protrude upward and are disposed at right angles relative to one another to permit attachment of such tabs along corners of support frames for rooftop grease exhausters. One or more holes may be drilled or otherwise formed in such hanger tabs to permit screws to be driven therethrough to support the associated components.

In certain embodiments, components such as troughs, corner sumps, end sumps, non-sump corner portions, and trough connectors include raised ridge elements positioned as travel stops for slip joints between components, with the raised ridges serving to aid in sealing between components joined by solvent welding or adhesive bonding. In one example, ends of a trough are arranged to fit into sleeve portions of components such as corner sumps, end sumps, non-sump corner portions, and trough connectors. Each trough has a preferably continuous raised ridge (i.e., as external raised ridge(s)) along exterior wall portions thereof, proximate to (e.g., within approximately 1 to 3 inches (25 to 75 cm) of ends of the trough. Similarly, each corner sump, end sump, non-sump corner portion, and trough connector preferably includes a preferably continuous raised ridge along interior wall portions thereof (i.e., as internal raised ridge(s)), proximate to (e.g., within approximately 1 to 3 inches (2.5 to 7.5 cm) of ends arranged to receive a trough. An end of a trough is inserted into a corresponding sleeve portion of a corner sump, end sump, non-sump corner portion, or trough connector (collectively, "the receiving component"), with the end of the trough preferably arranged to abut the raised ridge along interior walls of the receiving component, and with an end of the receiving component preferably arranged to abut the raised ridge along exterior walls of the trough. Such ridges therefore serve as travel stops for secure placement and to promote sealing between the trough and an adjacent receiving component. Multiple components as described above, including at least one sump (preferably multiple sumps), and at least one trough, are may be joined together to form an interconnected channel for retaining liquid.

In a preferred embodiment, multiple sumps are provided in a grease containment apparatus and are connected by at least one trough. Presence of multiple sumps is desirable to accommodate variations in pitch and available positioning for the grease containment apparatus, without requiring careful leveling of the various pieces of the apparatus. That is, presence of multiple sumps makes it more likely that at least one sump will be arranged lower than other interior portions of the grease, so that grease and any incident rainfall will flow to the low-lying sump. Additionally, presence of multiple sumps provides increased capacity for retaining liquid, including grease and water, thereby extending the requisite interval for cleaning the grease containment apparatus. At least one component (e.g., trough) of a grease containment apparatus is preferably arranged to receive grease from the roof-mounted grease exhauster via a pipe or spout directing grease into such component. In one embodiment, grease is directed via a pipe or spout into a trough disposed between two corner sumps, to ensure that grease will flow into at least one sump despite potential differences in level between such sumps.

Various components of a grease containment apparatus (e.g., troughs, corner sump assemblies, end sump assemblies, and corner portions) may have associated rain shields to deflect at least a portion of incident rain and thereby reduce accumulation of water therein. A rain shield preferably includes a downwardly-sloped upper wall to direct incident rain away from the interior of the grease containment apparatus. In one embodiment, a rain shield is integrally formed with a trough along an upper portion thereof, such as by molding the rain shield and the trough together as a single component. Rain shield may be formed separately from, but later added to, other components such as corner sumps, end sumps, and non-sump corner portions. Preferably, each rain shield does not fully cover an underlying component, and instead leaves a gap along an upper surface thereof to permit escape of water vapor from the interior of the grease containment apparatus. Such gap preferably also permits ingress of grease that may be discharged via a fan base (such as the base 506 illustrated in FIG. 9). As water collects in a grease containment apparatus according to the present invention (e.g., from direct ingress of rain and/or from the outlet of a grease exhauster), and grease collects therein, the water and grease will naturally separate due to differences in density, with the heavier water residing in a lower portion of the apparatus, and with the grease floating on top. As the grease collection apparatus (preferably dark colored polymeric material) is exposed to sunlight, walls of the apparatus are heated, thus preventing solidification of the grease, and also promoting vaporization of the water. This natural escape of water from the grease containment apparatus, combined with use of rain shields, reduces likelihood that the apparatus will overflow due to presence of large amounts of water, and eliminates the continuous need for grease separation and/or absorbent media within the grease containment apparatus. A preferred grease containment apparatus is therefore devoid of grease absorbent material within each sump and within each trough during routine operation.

In certain embodiments, each sump preferably includes a sealable (e.g., selectively closeable) drain aperture. Such drain aperture may include a removable drain plug. A drain plug may include a threaded plug arranged to engage a female threaded portion of a sump wall, with the female threaded portion preferably including a wall portion of enhanced thickness to provide structural support for the threads and prevent leakage. In one embodiment, a drain aperture is disposed along a side wall of a sump. Such drain aperture defined in side wall of a sump may be positioned close to (e.g., within 1-4 inches (2.5 to 10 cm) of a bottom wall of the sump, so as to permit heavier water to be drained from a sump prior to draining of lighter grease that may be floating atop the water. In one embodiment, a drain comprises a threaded plug, preferably including a connector portion (e.g., protruding square profile, protruding hex profile, inverted square profile, inverted hex profile, or other conventional shapes) to permit manipulation of the drain plug with a wrench or other suitable tool. In another embodiment, a drain aperture is disposed along a bottom wall of a sump.

A drain aperture may be opened by a maintenance worker to drain a sump (e.g., to drain water to waste and/or to drain grease into a grease collection receptacle for subsequent disposal). At the time periodic maintenance of a grease containment apparatus is initiated, a grease exhauster outlet conduit may be temporarily diverted to a portable waste receptacle by a maintenance worker. Such worker may remove one or more rain shields (e.g., as arranged over a corner sump, end sump, corner portion, or end cap), and add a grease absorbent material to contact and absorb grease within the grease containment apparatus. A drain plug associated with a sump drain aperture may then be opened to permit gravity draining of water from the sump. The grease absorbent media may be removed. The grease containment apparatus may further be cleaned with water (optionally heated) and/or a surfactant, and suitably drained, and then the drain aperture may be re-sealed with the drain plug to ready the apparatus for continued operation.

In certain embodiments, a drain aperture defined in a wall of a sump includes an associated drain conduit. A drain conduit may further comprise a drain plug (e.g., threaded plug) adapted for periodic removal (e.g., to permit draining) and replacement. A drain conduit may alternatively or additionally include one or more valves to permit selective draining of contents of a grease containment system, such as to permit draining to waste and/or a receptacle such as a catch basin or portable disposal container. Such valve(s) may be manually actuated, or automatically actuated responsive to one or more sensors arranged to sense level of liquid within a grease containment apparatus or portion thereof, and/or one or more rain sensors arranged to sense rainfall proximate to the grease containment apparatus. In one embodiment, multiple level sensors are arranged at different levels within a grease containment apparatus and operatively connected to a valve controller that receives inputs from a rain sensor. Sensing of a condition indicating rapid rise in liquid level within a grease containment apparatus, combined with receipt of significant rainfall, may indicate rapid accumulation of water within a grease containment system, and trigger need for opening of one or more valves (for draining of at least a portion of the contents of a grease containment apparatus) for a specified period of time or until a desired (low) liquid level is achieved, to prevent grease from overflowing a top portion of the grease containment apparatus. Actuated valves and control components may be operated by low voltage power, such as received from a grid-supplied AC/DC transformer, or optionally supplied by a battery fed by one or more solar cells arranged proximate to the grease containment apparatus (e.g., on a rooftop).

In one embodiment, a drain conduit operatively connected to a drain aperture of a sump of a grease containment apparatus defines a flow path, wherein at least a portion of the flow path is elevated above a bottom wall of at least one sump of the grease containment apparatus. A drain conduit may include one or more elbows and associated pipes arranged in a vertical or upward-sloping configuration to provide such elevated portion of the flow path. Providing an elevated portion of a drain flow path ensures that liquid will drain from the drain sump (by gravity) via the drain flow path only when liquid level within the sump is higher than the highest point of the drain flow path. The highest point of the drain flow path may be pre-set relative to a bottom wall of at least one sump of a grease containment system through use of a section of vertically oriented pipe (or a sloping section of pipe), and comparison of the relative heights utilizing a laser level, bubble-type level, or similar tool. In one embodiment, the highest point of the drain flow path in a range of between about 1-12 inches (2.5-30 cm), more preferably between 2-8 inches (3-20 cm), and still more preferably about 3-6 inches (4.5-15 cm), above the lowest point (e.g., bottom edge or bottom wall) of at least one sump of a grease containment system. Such a drain conduit may be operatively connected to a side wall or a bottom wall of a sump of a grease containment apparatus. In one embodiment, a grease containment apparatus comprises multiple sumps, and each sump has an associated drain conduit wherein a portion of a flow path defined by each drain conduit is above a bottom wall or edge of each sump. In one embodiment, a grease containment apparatus comprises multiple sumps, and each sump has an associated drain conduit, wherein the drain conduits are both connected at a junction to supply liquid to one or more common outlets, wherein a portion of an interconnected flow path at or downstream of such junction is above a bottom wall or edge of each sump.

In one embodiment, at least one catch basin is arranged to receive water from a drain conduit of a grease containment assembly having at least one sump, wherein water is drained from a sump through a flow path including at least a portion that is elevated above a bottom wall of the sump. In one embodiment, the catch basin has an associated drain conduit defining a flow path that is elevated above a bottom wall of the catch basin, and water is drained from the catch basin through the catch basin flow path. Such a catch basin may be provided to catch grease that may be discharged from a grease containment apparatus (e.g., if the grease level should unexpectedly rise above the high point of the sump drain flow path). A catch basin may include an associated rain shield. A drain conduit for a catch basin may define a catch basin drain flow path including at least a portion arranged at a level above a bottom wall or edge of the catch basin, for draining of water from the catch basin through the catch basin drain flow path. In one embodiment, multiple catch basins may be arranged at different levels in cascading format, with one catch basin draining into another. Draining of water from a grease containment apparatus to one or more catch basins is preferably motivated exclusively by gravity. As an alternative to utilization of one or more catch basins, or in conjunction with use of one or more catch basins, grease absorbent material may be arranged to receive water discharged from a sump of a grease containment apparatus and/or a catch basin arranged downstream of such a grease containment apparatus. Grease absorbent material may optionally be placed within a catch basin. A grease absorbent material preferably is adapted to preferentially absorb grease relative to absorption of water.

Grease containment apparatuses and components therefor according to certain illustrative embodiments are depicted in the appending figures. Such figures are provided to aid in the understanding of exemplary embodiments and should not be construed to limit the extent or scope of Applicants' invention.

Figure 1A:
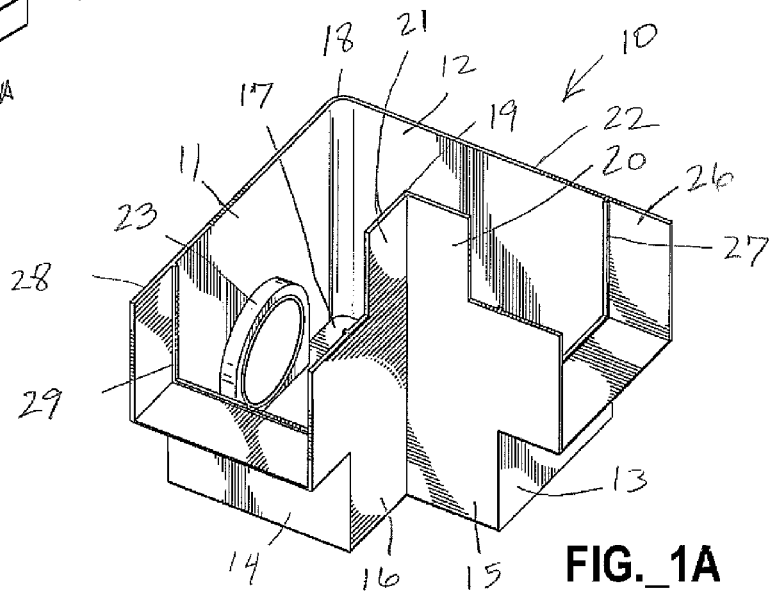
FIG. 1A is perspective view of a corner sump assembly constituting part of a grease containment apparatus according to one embodiment of the present invention.
Figure 2B:
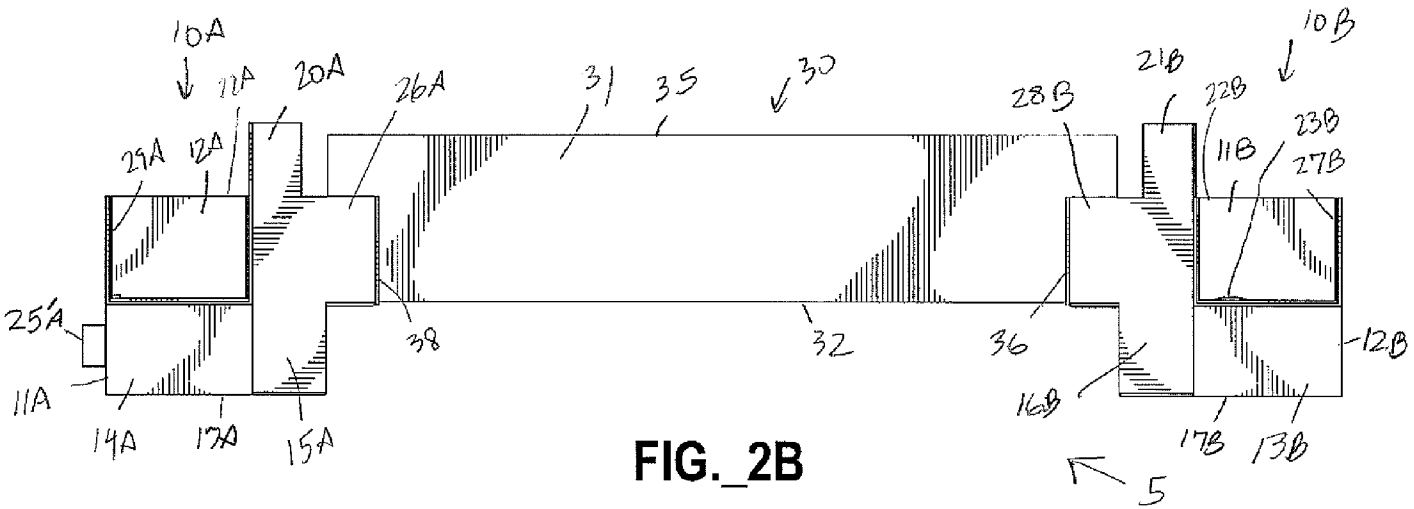
FIG. 2B is a rear elevation view of the portion of the grease containment apparatus of FIG. 2A.
Figure 2C:
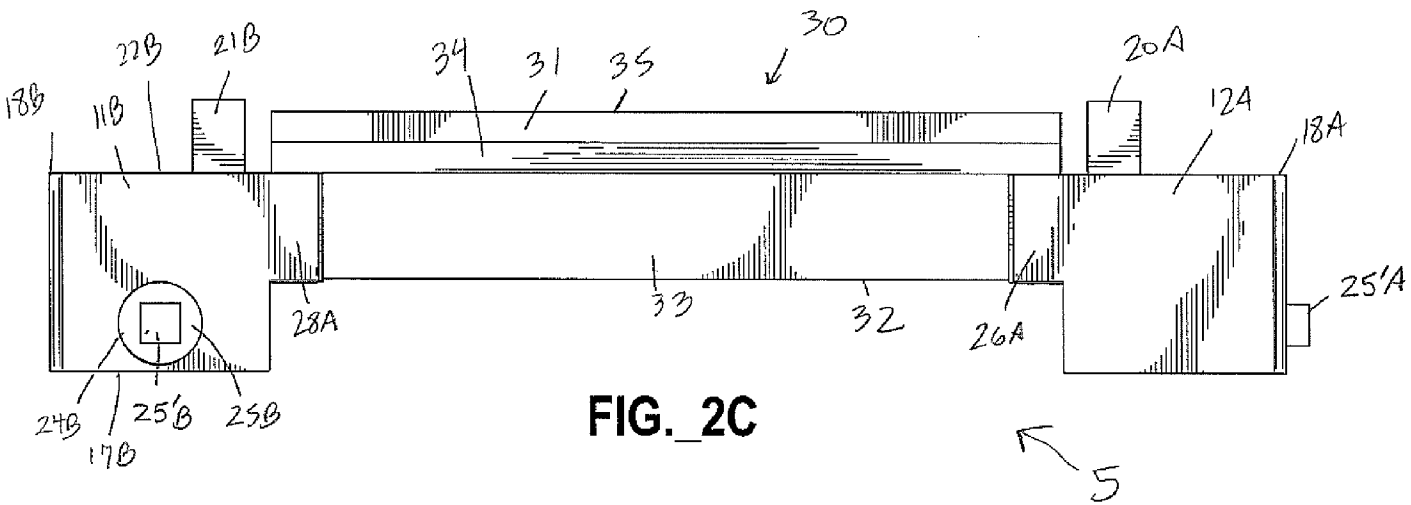
FIG. 2C is a front elevation view of the portion of the grease containment apparatus of FIGS. 2A-2B.
Figure 2D:
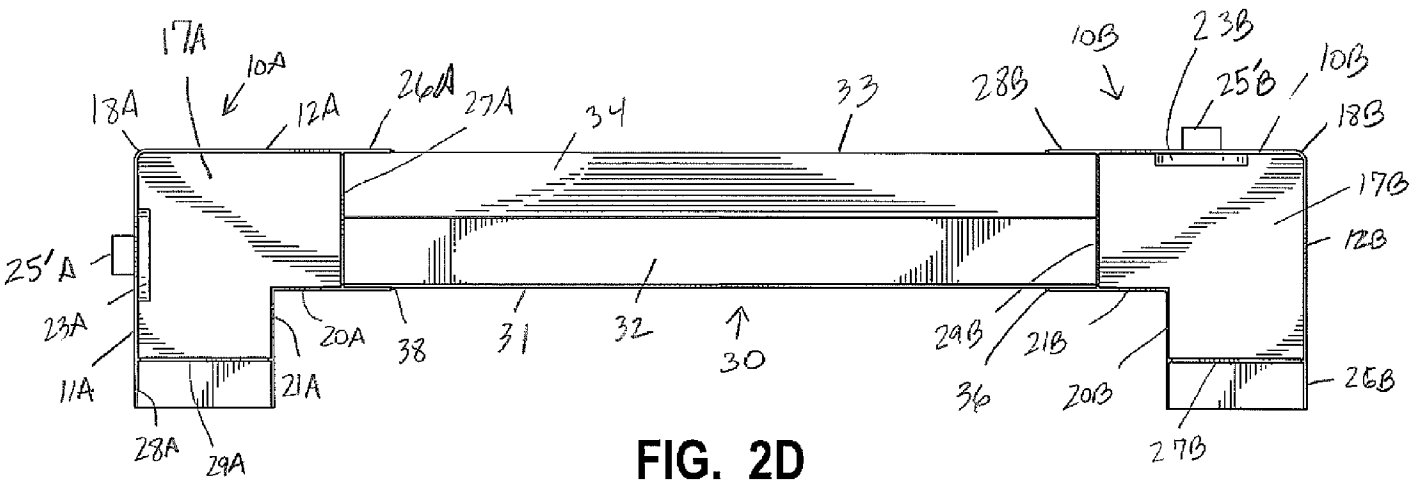
FIG. 2D is a top plan view of the portion of the grease containment apparatus of FIGS. 2A-2C.
Figure 2E:
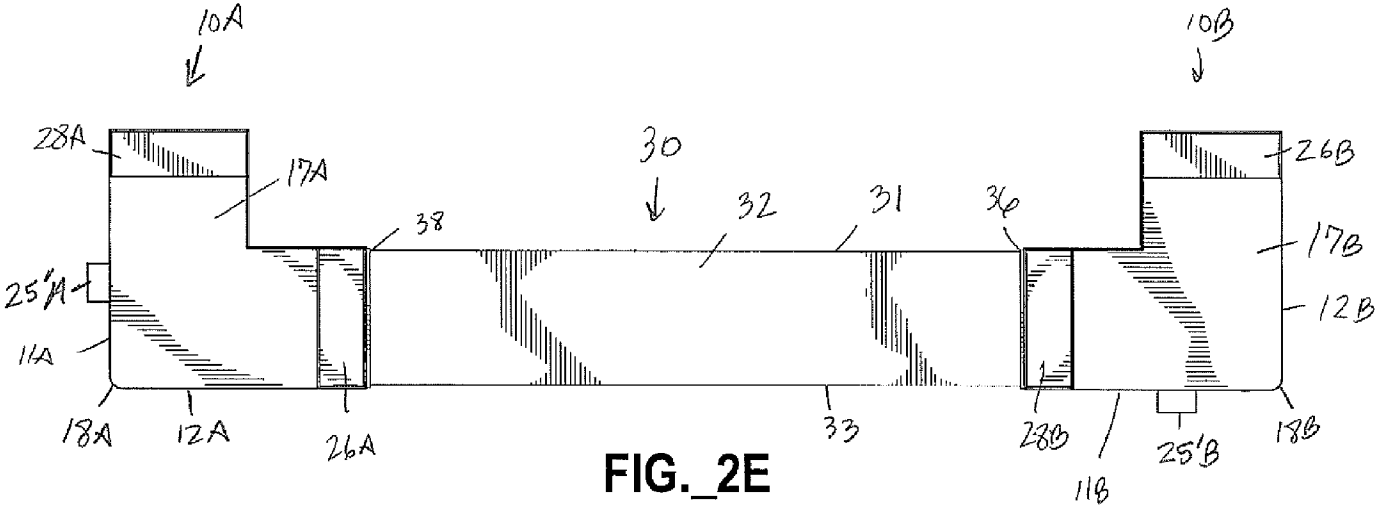
FIG. 2E is a bottom plan view of the portion of the grease containment apparatus of FIGS. 2A-2D.
Figure 3A:
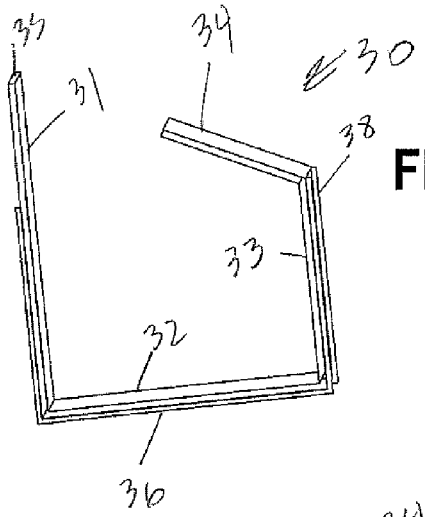
FIG. 3A is a side perspective view of a trough constituting part of a grease containment apparatus according to certain embodiments of the present invention.
Figure 3B:
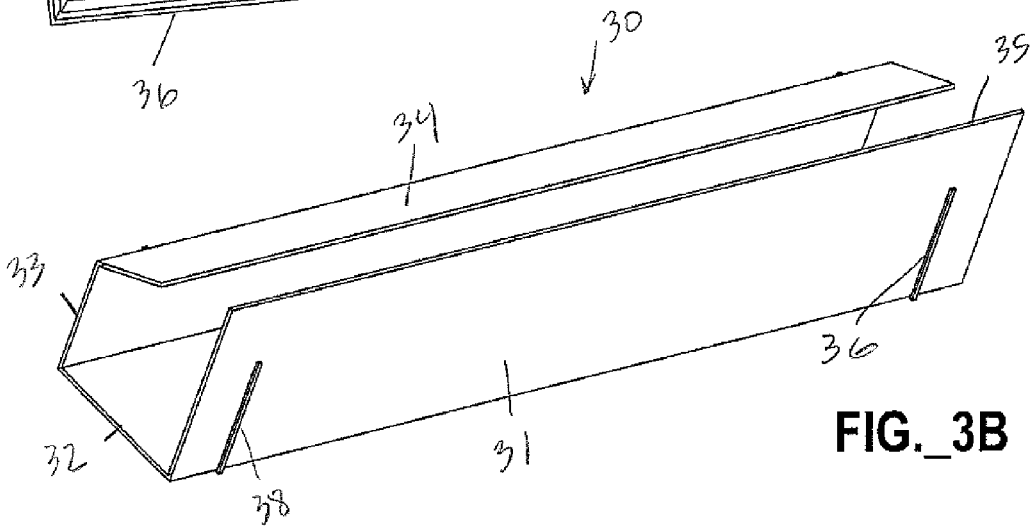
FIG. 3B is an upper rear perspective view of the trough of FIG. 3A.
Figure 3C:
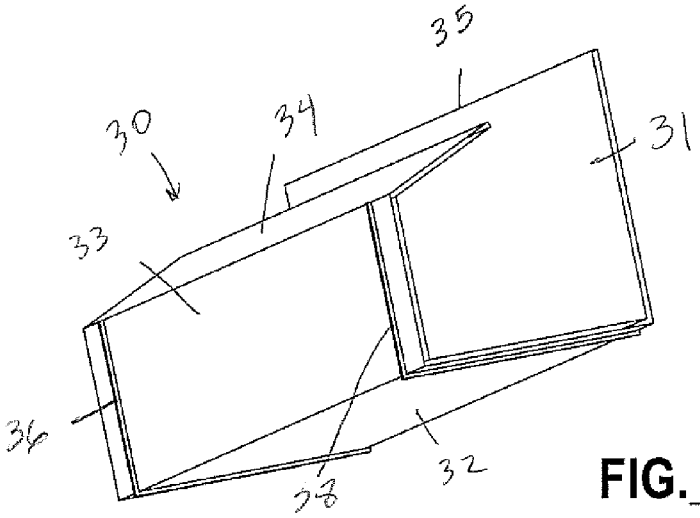
FIG. 3C is a lower front perspective view of the trough of FIGS. 3A-3B.

FIGS. 1A-1B illustrate a corner sump assembly 10 constituting part of a grease containment apparatus according to one embodiment of the present invention. The corner sump assembly 10 comprises a first side wall 11, second side wall 12, third side wall 13, fourth side wall 14, fifth side wall 15, and sixth side wall 16, as well as a bottom wall 17. The first side wall 10 and second side wall 12 meet at a corner 18. The first side wall 11 includes a thickened portion 23 defining a drain aperture 24 for receiving a drain plug 25 having an associated manipulating feature 25' (e.g., as illustrated, having a raised or protruding square profile arranged to permit grasping with a wrench (not shown)). The third side wall 13 and fourth side wall 14 each include a sleeve portion 26, 28 having arranged for receiving therein a trough section (not shown), with each sleeve portion 26, 28 including an internal raised ridge 27, 28 against which an end of a trough inserted into the sleeve portion 26, 28 may abut. The fifth side wall 15 and sixth side wall 16 include hanger tab portions 20, 21 extending upward therefrom (higher than the upper edge 22 of the first and second side walls 11, 12), and arranged at ninety degree angles relative to one another for mounting along a corner of a pedestal or duct support of a rooftop grease exhauster (not shown). A sump having a height coextensive with the height of the third and fourth side walls 13, 14, extends downward relative to the sleeve portions 26, 28, and is bounded by the bottom wall 17, and the first through sixth side walls 11-16.

Figure 5:
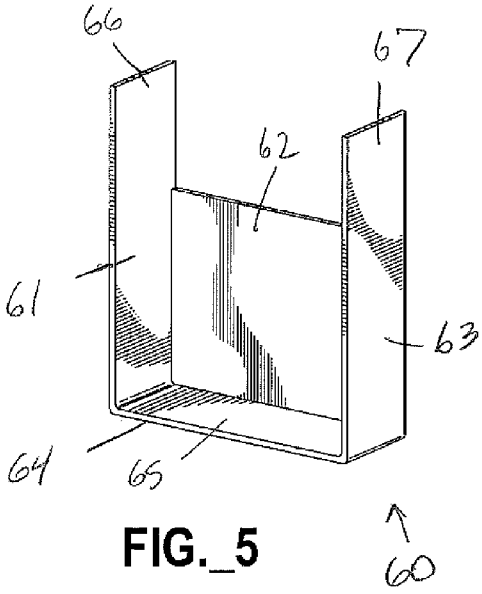
FIG. 5 is an upper perspective view of an end cap constituting part of a grease containment apparatus according to one embodiment of the present invention.

FIGS. 2A-2E illustrate at least a portion of a grease containment apparatus 5 including one trough 30 connected to two corner sump assemblies 10A, 10B (such as depicted in FIGS. 1A-1B) according to another embodiment of the present invention. The grease containment apparatus 5 includes two open sleeves 28A, 27B to which additional components may be joined, such as additional troughs (not shown), or end caps 60 (as illustrated in FIG. 5, with each end cap 60 including side walls 61, 63, a bottom wall 65, an end wall 62, hanger tabs 66, 67, and an edge 64 opposing the end wall 62). Each corner sump assembly 10A, 10B is substantially identical to the corner sump assembly 10 of FIGS. 1A-1B, with each corresponding portion thereof including a label terminated with "A" or "B," respectively. Each corner sump 10A, 10B includes a first side wall 11A, 11B, second side wall 12A, 12B, third side wall 13A, 13B, fourth side wall 14A, 14B, fifth side wall 15A, 15B, sixth side wall 16A, 16B, and bottom wall 17A, 17B, with the first side walls 11A, 11B meeting the second side walls 12A, 12B at corners 18A, 18B. Each first side wall 11A, 11B includes a thickened portion 23A, 23B defining a drain aperture 24A, 24B for receiving a drain plug 25A, 25B having an associated manipulating feature 25'A, 25'B. Each third side wall 13A, 13B and fourth side wall 14A, 14B each include a sleeve portion 26A, 26B, 26B, 28B, with sleeve portions 26A, 28B receiving the trough 30, and with the other sleeve portions 26B, 28A illustrated as being open. Each sleeve portion 26A, 26B, 28A, 28B includes an internal raised ridge 27A, 27B, 28A, 28B for abutting an end of a trough inserted therein. The fifth side walls 15A, 15B and sixth side walls 16A, 16B include hanger tab portions 20A, 20B, 21A, 21B extending upward therefrom.

As shown in FIGS. 2A-2E and FIGS. 3A-3C, the trough 30 includes a rear wall 31, a bottom wall 32, a front wall 33, and a trough rain shield portion 34. The trough rain shield portion 34 is angled upward relative to the front wall 33 in a direction toward the back wall 31, but the trough rain shield portion does not fully extend to contact the back wall 31, thereby leaving a gap between the rain shield portion 34 and the back wall 31 to permit escape of vapor generated by evaporation of water within the grease containment assembly 5. The rear wall 31 preferably extends higher than the front wall 33.

Figure 4A:
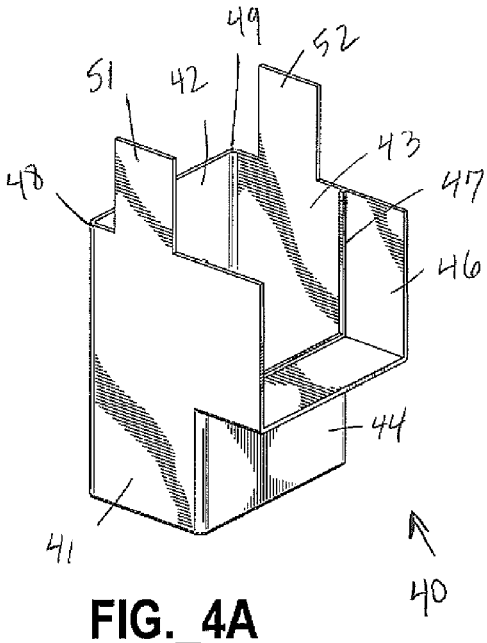
FIG. 4A is an upper perspective view of an end sump constituting part of a grease containment apparatus according to one embodiment of the present invention.
Figure 4B:
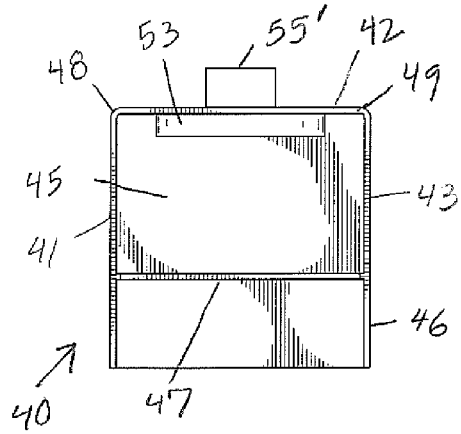
FIG. 4B is a top plan view of the end sump of FIG. 4A.
Figure 10A:
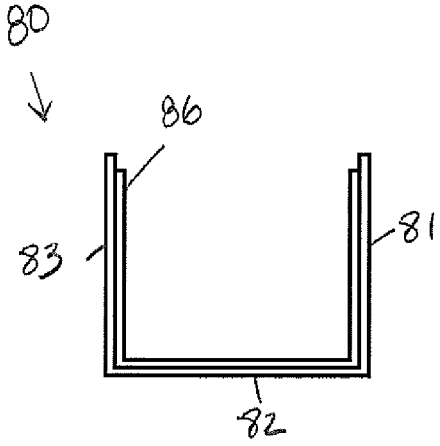
FIG. 10A is a side elevation view of a trough connector including an internal raised ridge portion, the trough connector being adapted for connection of two trough sections.
Figure 10B:
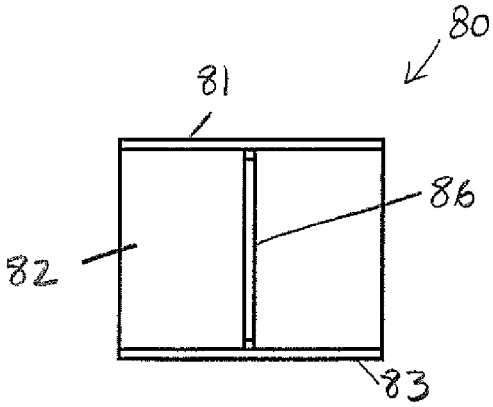
FIG. 10B is a top plan view of the trough connector of FIG. 10A.

If a trough 30 provided in a standard length is not long enough to span an entire side of a pedestal or duct supporting a rooftop grease exhauster (not shown), then multiple troughs (or portions thereof) may be connected to one another utilizing a trough connector, such a the trough connector 80 shown in FIGS. 10A-10B. The trough connector 80 includes a first side wall 81, second side wall 83, and a bottom wall 82, with a raised ridge 86 defined along internal surfaces of the walls 81-83. Ends of two troughs or sections thereof may be inserted into the open ends of the trough connector 80 and affixed thereto, such as by solvent welding, adhesive connection, or any other suitable attachment means preferably providing sealing engagement without leakage between connected components. In one embodiment, sealing gaskets (not shown) may be provided between adjacent components at the time of assembly FIGS. 4A-4B illustrate an end sump assembly 40 constituting part of a grease containment apparatus according to one embodiment of the present invention. The end sump assembly 40 includes a first side wall 41, second side wall 42, third side wall 43, fourth side wall 44, and bottom wall 45. The second side wall 42 includes a thickened portion 53 arranged to receive a drain plug having a manipulating feature 55'. The sleeve portion 46 includes an internal raised ridge 46 arranged to abut an end of a trough (not shown) inserted into the sleeve portion 46. A sump having a height coextensive with the height of the fourth side walls 44, extends downward relative to the sleeve portion 46, and is bounded by the bottom wall 45 as well as the first through fourth side walls 41-44. The first side wall 48 and second side wall 42 meet at a first corner 48, and the second side wall 42 and the third side wall 43 meet at a second corner 49. Hanger tabs 51, 52 extend upward from the first and third side walls 41, 43, and are preferably integrally formed with the end sump assembly 40. Presence of hanger tabs 51, 52 on opposing side walls 41, 43 permits the end sump assembly 40 to be interchangeably mounted with either the first or third side walls 41, 43 adjacent to a pedestal or duct support of a roof top grease exhauster (not shown).

Figure 6A:
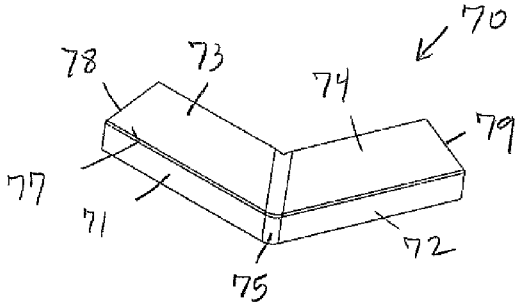
FIG. 6A is an upper perspective view of a corner rain shield constituting part of a grease containment apparatus according to one embodiment of the present invention.
Figure 6B:
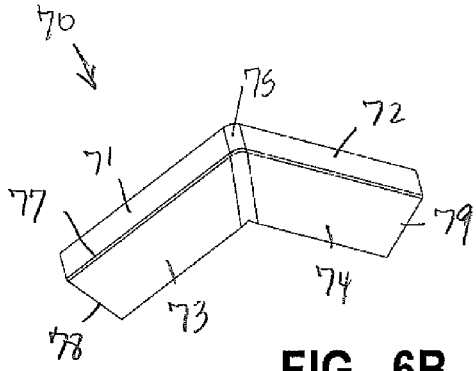
FIG. 6B is a lower perspective view of the corner rain shield of FIG. 6A.

FIGS. 6A-6B illustrate a rain shield 70 arranged for use with a corner sump assembly or corner trough assembly (as illustrated and described elsewhere herein). Unlike the rain shield portion 34 that is preferably integrally formed with the trough 30 (e.g., via molding), the rain shield 70 is preferably formed separately from an corner sump assembly or corner trough assembly, due in part to difficulty of forming same with such a corner sump assembly or a corner trough assembly, and due in part to permit removability of the rain shield 70 to enable cleaning of a corner sump assembly. A rain shield 70 includes a first side wall 71, second side wall 72, first angled wall 73, second angled wall 74, and a corner 75, with the walls 71-74 extending between two ends 78, 79. The rain shield 70 is preferably removably affixed to a corner sump assembly or corner trough assembly by any conventional means, such as but not limited to screws or similar fasteners.

Figure 7:
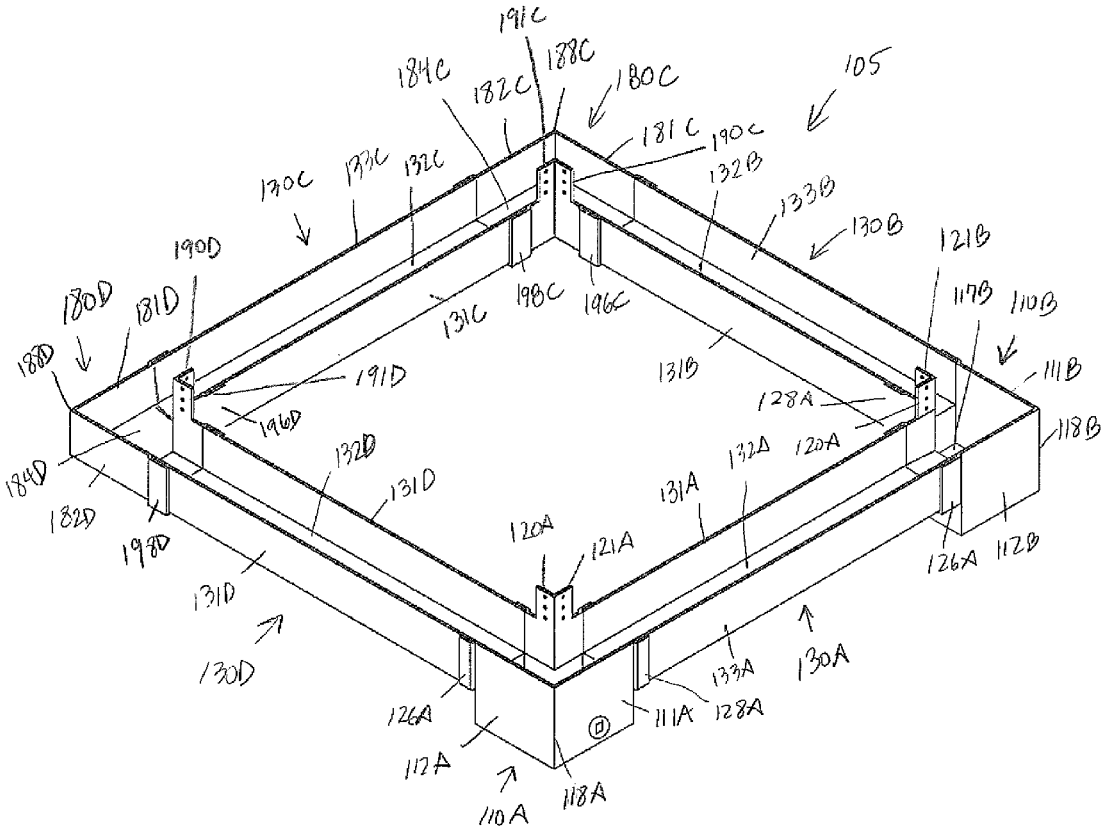
FIG. 7 is an upper perspective view of a grease containment apparatus including four troughs, two corner sump assemblies, and two corner troughs according to one embodiment of the present invention.

FIG. 7 illustrates a grease containment apparatus 105 including four troughs 130A-130D, two corner sump assemblies 110A, 110B, and two corner trough assemblies 180C, 180D according to one embodiment of the present invention. Such components 130A-130D, 110A, 110B, 180C, 180D may be affixed to one another via solvent welding, adhesive joining, or other conventional attachment means. The grease containment apparatus 105 is adapted for mounting to a duct support of a rooftop grease exhauster fan (such as the duct 504 illustrated in FIG. 9), preferably with a grease discharge pipe or spout positioned over the first trough 130A disposed between corner sump assemblies 110A, 110B to ensure that any grease discharged into the apparatus 105 will tend to flow toward a sump associated with one or the other of the corner sump assemblies 110A, 110B.

Each corner sump assembly 110A, 110B is substantially identical to the corner sump assemblies 10A, 10B of FIGS. 2A-2E with corresponding reference numerals increased by 100. To promote simplicity and ease of understanding, reference numerals for certain elements have been omitted from FIG. 7. Although rain shield portions are preferably integrally formed with the troughs 130A-130D, rain shield portions have been omitted from the troughs 130A-130D to promote simplicity and ease of understanding; likewise, each corner sump assembly 110A, 110B and corner trough assembly 180C, 180D is illustrated without addition of any corner rain shield (such as the shield 70 shown in FIGS. 6A-6B), but it is to be understood that such rain shields would preferably be present in a preferred embodiment.

Each trough 130A-130D includes a rear wall 131A-131D, bottom wall 132A-132D, and front wall 133A-133D. Each trough 130A-130D is inserted into sleeve portions provided by two different corner sump assemblies 110A, 110B and/or corner trough assemblies 180C, 180D. Raised ridges may be formed along external wall portions proximate to ends thereof.

Each corner sump assembly 110A, 110B includes a first side wall 111A, 111B and a second side wall 112A, 112B meeting at corners 118A, 118B, respectively. Each corner sump assembly 110A, 110B further includes two sleeve portions 126A, 128A, 126B, 128B, and a bottom wall 117A, 117B that is positioned below the sleeve portions 126A, 128A, 126B, 128B. Hanger tab portions 120A, 121A, 120B, 121B extend upward relative to the first and second side walls 110A, 112A, 110B, 112B.

Each corner trough assembly 180C, 180D is similar to the corner sump assemblies 110A, 110B except for the lack of a sump portion. Each corner trough assembly 180C, 180D includes first and second side walls 181C, 181D, 182C, 182D and a bottom wall 184C, 184D, with two sleeve portions 196C, 198C, 196D, 198D. Hanger tab portions 190C, 191C, 190D, 191D extend upward relative to the first and second side walls 181C, 181D, 182C, 182D.

Figure 9:
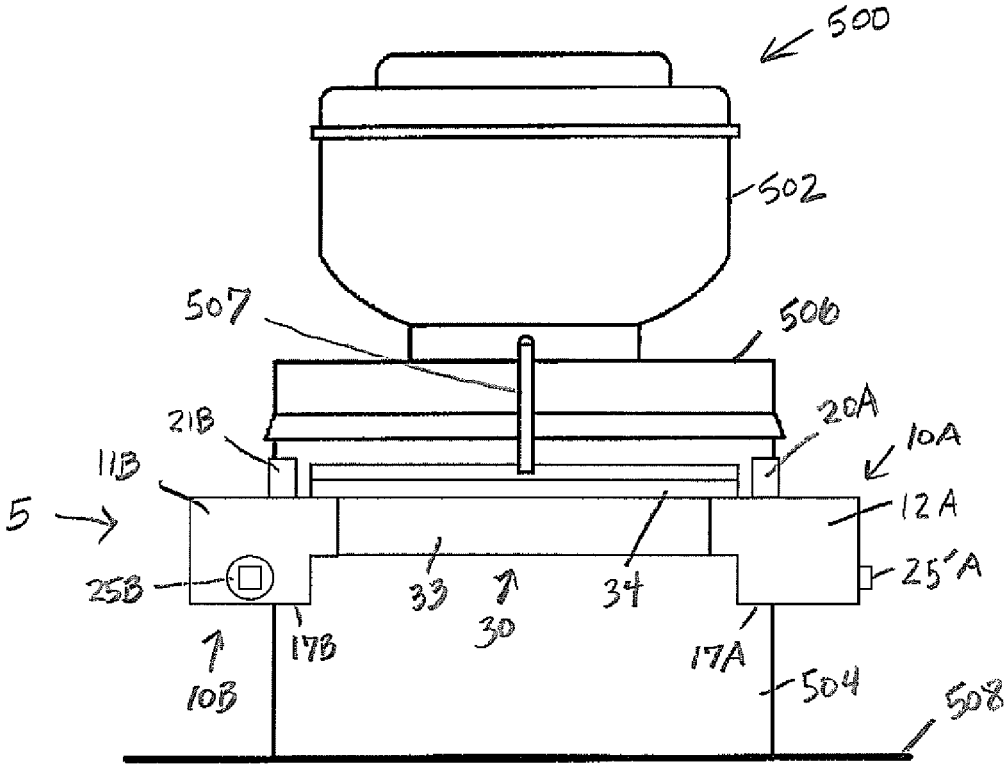
FIG. 9 is a side elevation view of a rooftop grease exhauster having mounted thereon a multi-sump grease containment apparatus according to one embodiment of the present invention, with a grease drain pipe arranged to conduct grease from the exhauster into a trough of the grease containment apparatus.

FIG. 9 illustrates a rooftop grease exhauster 500 including a fan 502, a fan base 506, and a kitchen exhaust duct 504 to which a multi-sump grease containment apparatus 5 according to one embodiment of the present invention is mounted. The exhaust duct 504 protrudes upward from a roof 508 of a building. A grease drain pipe 507 is arranged to conduct grease from the exhauster fan 502 behind a trough rain shield portion 34 (and front wall 33) into a trough 30 of the grease containment apparatus 5, between corner sump assemblies 10A, 10B of such apparatus 5. Each corner sump assembly 10A, 10B is suspended from the duct 504 by attachment of the hanger tabs 20A, 21B to the duct 504. Each corner sump has a bottom wall 17A, 17B arranged along a lower edge of side walls 11A, 11B, 12A, 12B, with one side wall of each corner sump assembly 10A, 10B defining a drain aperture 25A, 25B having an associated removable plug. While ideally grease is meant to collect and discharge through the grease spout, some grease may discharge around the fan base 506 that serves to connect the exhaust fan 502 to the exhaust duct 504. Preferably, the grease containment apparatus is assembled to form a continuous gutter around the entire duct 504, assuming lack of interference with adjacent structural elements and/or mechanical equipment (not shown) arranged on the rooftop 508 proximate to the duct 504. In one embodiment, adhesive and/or sealing gasket material (not shown) may be provided between each component of a grease containment system 5 (e.g., trough(s) 30, corner sumps 10A, 10*b*, etc.) and the exhaust duct 504 to ensure than an grease leaking from the fan base 506 does not seep between the duct 504 and the grease containment assembly 5 mounted thereto, but rather collects in the grease containment assembly 5 as intended.

Although one-sided and four-sided grease containment apparatuses have been illustrated in the accompanying figures, it is to be appreciated that grease containment apparatuses having one, two, three, or four sides may be constructed utilizing components as described herein, and easily assembled in the field utilizing such components without requiring custom shop fabrication (as has been required with traditional sheetmetal-based trough systems including grease absorbent media). A kit including various pre-made components (e.g., troughs, sumps, corner portions, trough connectors, end caps, rain shields) as described above herein may be installed in the field, optionally including steps such as taking measurements in the field, cutting any standardized polymeric components (e.g., via manually operated hacksaw or cordless circular saw), joining corner and/or end assemblies to an exhaust duct (or other fan support) with fasteners, affixing troughs (optionally including intermediate trough connectors) to the corner and/or end assemblies (e.g., preferably using solvent welding and/or adhesive joining), and covering any corner and/or end assemblies with associated rain shields.

Figure 8A:
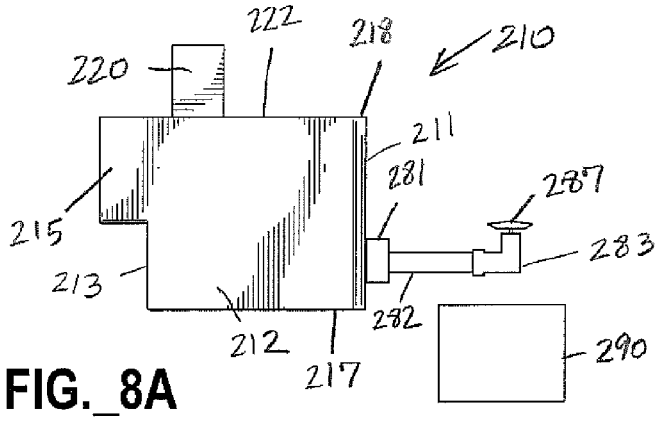
FIG. 8A is a side elevation view of a corner sump assembly having a side outlet connected to a first drain conduit having a top outlet arranged over a catch basin.
Figure 8B:
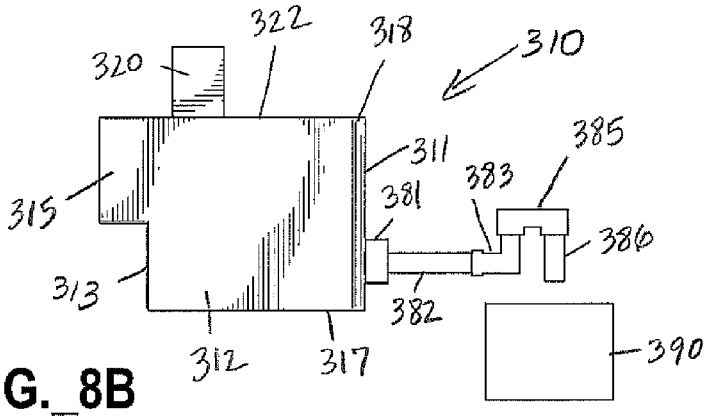
FIG. 8B is a side elevation view of a corner sump assembly having a side outlet connected to a second drain conduit having a bottom outlet arranged over a catch basin.
Figure 8C:
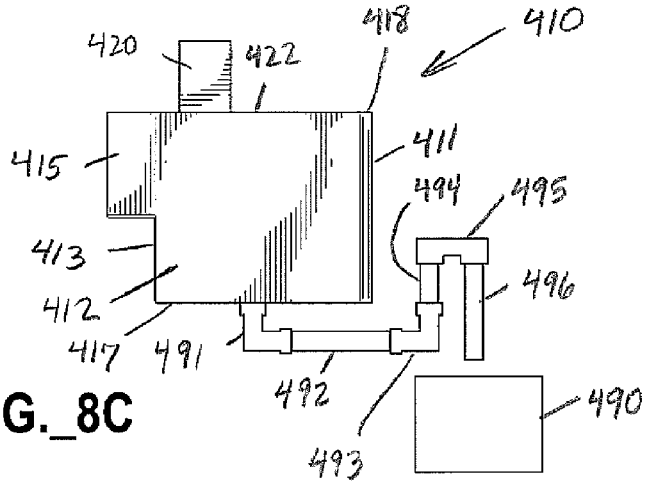
FIG. 8C is a side elevation view of a corner sump assembly having a bottom outlet connected to a third drain conduit having a bottom outlet arranged over a catch basin.

As described previously herein, certain embodiments include use of sumps having associated drain conduits, wherein at least a portion of a flow path defined by the drain conduit is arranged higher than a bottom wall of an associated sump. FIGS. 8A-8C illustrate corner sump assemblies 210, 310, 410 each having a drain conduit in a different configuration.

Referring to FIG. 8A, a corner sump assembly 210 includes a first side wall 211 defining an aperture into which a connector 281 is fitted. The corner sump assembly 210 further includes a second side wall 212 (which meets the first side wall 211 at a corner 218), a third side wall 213 disposed below a sleeve portion 215, a bottom wall 217, and a hanger tab 220 extending above a top edge 222 of the first and second side walls 211, 212. A pipe 282 extends outward from the connector 281, and an elbow 283 with an associated rain cover 287 extends from the pipe 282. The elbow 283 and rain cover 287 are optionally disposed above a catch basin 290 (which may optionally include grease absorbent material and/or another drain pipe (not shown)). The rain cover 287 prevents ingress of rain water into the elbow 283, but is open along sides thereof to permit discharge of water from the sump portion (e.g., having height coextensive with the third side wall 213) of the corner sump assembly 210 when the water level within the sump rises above the opening between the elbow 283 and the rain cover 287. Height of such opening relative to the bottom wall of the sump (e.g., bottom wall 217) may be adjusted by including a longer elbow 283 and/or providing an optional pipe section (not shown) extending upward from the elbow 283. The intention is to draw water from a lower portion of a grease containment assembly (e.g., the corner sump assembly) without discharging grease, which will tend to float above any water residing within a grease containment assembly due to gravimetric separation between the two. It may also be desirable to avoid drawing water from the very bottom of a grease containment assembly to avoid discharging any grease-borne solids that may gravimetrically settle to the bottom. A drain conduit as described herein may be provided in a grease containment assembly installed in an environment subject to substantial rainfall. In one embodiment, water is added to a corner sump assembly after cleaning thereof is complete, to ensure that a minimum water level is provided in the sump so as to prevent grease from draining via a drain conduit.

Referring to FIG. 8B, a corner sump assembly 310 includes a first side wall 311 defining an aperture into which a connector 381 is fitted. The corner sump assembly 310 further includes a second side wall 312 (which meets the first side wall 311 at a corner 318), a third side wall 313 disposed below a sleeve portion 315, a bottom wall 317, and a hanger tab 320 extending above a top edge 322 of the first and second side walls 311, 312. Extending outward from the connector 381 is a pipe 382, a first elbow 383, a flow reversing element 385, and an outlet pipe 386. The flow reversing element 385 is disposed above the bottom wall 317 of the sump portion of the corner sump assembly 310 (with the height of the sump portion being coextensive with the third wall 313). The outlet pipe 386 is optionally disposed above a catch basin 290 (which may optionally include grease absorbent material and/or another drain pipe (not shown)). When water level within the sump rises above the flow reversing element 385, water will flow (via gravity) through the drain conduit (including conduit elements 382, 383, 385, 386) to the optional catch basin 390.

Referring to FIG. 8C, a corner sump assembly 410 includes a first side wall 411, a second side wall 412 that meets the first side wall 411 at a corner 418, a third side wall 413 disposed below a sleeve portion 415, and a hanger tab 420 extending above a top edge 422 of the first and second side walls 411, 412. Extending from the bottom wall is a first elbow 491, a lateral pipe 491, a second elbow 493, a vertical pipe 494, a flow reversing element 495, and an outlet pipe 496. The flow reversing element 495 is disposed above the bottom wall 417 of the sump portion of the corner sump assembly 410 (with the height of the sump portion being coextensive with the third wall 413). The outlet pipe 496 is optionally disposed above a catch basin 490 (which may optionally include grease absorbent material and/or another drain pipe (not shown)). When water level within the sump rises above the flow reversing element 495, water will flow (e.g., motivated exclusively via gravity) through the drain conduit (including conduit elements 491, 492, 493, 494, 495, 496) to the optional catch basin 490.

In further embodiments, one or more drain assemblies as disclosed in U.S. Provisional Patent Application No. 61/330,255 filed on Apr. 30, 2010 (which application is hereby incorporated by reference as if set forth fully herein) may be utilized in connection with a grease containment system as disclosed herein.

A grease containment system and drain as described herein in combination may be used to automatically and preferentially drain water in comparison to grease from the grease containment apparatus, and do so in a manner exclusively motivated by gravity.

In one embodiment, a pump may be operatively coupled with a drain conduit as disclosed herein, optionally with one or more appropriate sensors (e.g., level sensors, pressure sensors conductivity sensors, etc.) arranged in or along the drain conduit and/or a sump of a grease containment system, to permit control of the pump responsive to signals received from the pump.

While the invention has been has been described herein in reference to specific aspects, features and illustrative embodiments of the invention, it will be appreciated that the utility of the invention is not thus limited, but rather extends to and encompasses numerous other variations, modifications and alternative embodiments, as will suggest themselves to those of ordinary skill in the field of the present invention, based on the disclosure herein. Correspondingly, the invention as hereinafter claimed is intended to be broadly construed and interpreted, as including all such variations, modifications and alternative embodiments, within its spirit and scope.

What is claimed is:

1. A grease containment apparatus adapted to receive grease from a rooftop grease exhauster, the grease containment apparatus comprising:

a plurality of sumps, wherein each sump of the plurality of sumps includes a bottom wall and a plurality of sidewalls; and at least one trough operatively arranged between the plurality of sumps to conduct liquid to at least one sump of the plurality of sumps;

wherein a portion of each sump of the plurality of sumps is arranged at a level below a lower edge of the at least one trough; and wherein at least one sump of the plurality of sumps includes a bottom wall arranged to collect liquid, the at least one sump being devoid of any open drain defined in the bottom wall or any sidewall of the at least one sump.

2. The grease containment apparatus of claim 1, wherein each of the at least one trough and the plurality of sumps comprises polymeric material resistant to modification or degradation in exposure to ultraviolet radiation.

3. The grease containment apparatus of claim 1, wherein each of the at least one trough and the plurality of sumps comprises acrylonitrile butadiene styrene/polycarbonate.

4. The grease containment apparatus of claim 1, wherein each sump of the plurality of sumps is embodied in a corner sump assembly or an end sump assembly having at least one sleeve portion arranged to receive therein an end of a trough of the at least one trough.

5. The grease containment apparatus of claim 4, wherein each corner sump assembly or end sump assembly is sealed to the at least one trough by solvent welding or adhesive bonding.

6. The grease containment apparatus of claim 4, wherein each corner sump assembly or end sump assembly, and each trough of the at least one trough, has an associated rain shield.

7. The grease containment apparatus of claim 4, comprising at least one of the following features (a) and (b):

(a) the at least one trough comprises at least one external raised ridge disposed along exterior surfaces of the at least one trough and arranged to abut an edge of a sleeve portion; and (b) each sleeve portion comprises at least one internal raised ridge disposed along interior surfaces of the sleeve portion and arranged to abut an end of a trough of the at least one trough.

8. The grease containment apparatus of claim 1, wherein the at least one trough comprises a plurality of troughs.

9. The grease containment apparatus of claim 1, being devoid of grease absorbent material within the plurality of sumps and within the at least one trough.

10. The grease containment apparatus of claim 1, wherein at least one sump of the plurality of sumps comprises a drain aperture and a removable drain plug arranged to seal the drain aperture.

11. The grease containment apparatus of claim 1, wherein at least one sump of the plurality of sumps comprises a drain aperture and a drain conduit arranged to receive liquid from the drain aperture, wherein at least a portion of a flow path defined by the drain conduit is elevated above a bottom wall of the at least one sump.

12. The grease containment apparatus of claim 4, further comprising at least one hanger tab integrally formed with each corner sump assembly or end sump assembly and arranged to support the grease containment apparatus to receive grease from the rooftop grease exhauster.

13. The grease containment apparatus of claim 1, wherein each sump of the plurality of sumps includes a bottom wall arranged to collect liquid, and each sump is devoid of any open drain defined in the bottom wall or any sidewall of the respective sump.

* * * * *